US006048586A

United States Patent [19]

Burris et al.

[11] Patent Number: 6,048,586

[45] Date of Patent: Apr. 11, 2000

[54] PROCESS FOR APPLYING A FUNCTIONAL GRADIENT MATERIAL COATING TO A COMPONENT FOR IMPROVED PERFORMANCE

[75] Inventors: Kenneth W. Burris, Peoria; M. Brad Beardsley, Laura; Leonid Chuzhoy, Dunlap, all of Ill.

[73] Assignee: Caterpillar Inc., Peoria, Ill.

[21] Appl. No.: 09/057,050

[22] Filed: Apr. 8, 1998

Related U.S. Application Data

[60] Continuation-in-part of application No. 08/720,845, Oct. 3, 1996, abandoned, which is a division of application No. 08/658,332, Jun. 5, 1996, abandoned.

[51] Int. Cl.[7] ..... C23C 4/04; B05D 1/08

[52] U.S. Cl. ..... 427/446; 427/450; 427/453; 427/455; 427/456

[58] Field of Search ..... 427/453, 455, 427/446, 450, 456

[56] References Cited

U.S. PATENT DOCUMENTS

| | | | |
|---|---|---|---|
| 3,753,666 | 8/1973 | Carroll | 29/195 |
| 3,779,720 | 12/1973 | Ellis et al. | 29/195 |
| 3,896,244 | 7/1975 | Ellis et al. | 427/34 |
| 4,146,654 | 3/1979 | Guyonnet | 427/34 |
| 4,163,071 | 7/1979 | Weatherly et al. | 427/34 |
| 4,173,685 | 11/1979 | Weatherly | 428/556 |
| 4,503,085 | 3/1985 | Dickson et al. | 427/34 |
| 4,526,618 | 7/1985 | Keshavan et al. | 106/1.05 |
| 4,751,099 | 6/1988 | Niino et al. | 427/34 |
| 4,806,394 | 2/1989 | Steine | 427/423 |

FOREIGN PATENT DOCUMENTS

| | | |
|---|---|---|
| 0123 952 | 11/1984 | European Pat. Off. . |
| 0170 359 | 2/1986 | European Pat. Off. . |
| 0217 991 | 4/1987 | European Pat. Off. . |
| 0 285 313 A2 | 10/1988 | European Pat. Off. . |
| 139 3 475 | 7/1965 | France . |
| 37 06340 | 9/1988 | Germany . |
| 41 14 962 | 11/1992 | Germany . |

OTHER PUBLICATIONS

Application: Advanced Thermal Spray Coatings for Corrosion and Wear Resistance, Tucker, Jr. & Ashary, Praxair Surface Technologies, Inc. (no month date) 1995.

Article: MRS Bulletin/Jan. 1995 Thermal Spray Processing of FGMs, S.Sampath, H. Herman, N. Shimoda, & T. Saito.

Patent abstracts of Japan, vol. 007, No. 139 (C–171), Japan 58–052 469A, abstract, Jun., 1983.

*Primary Examiner*—Katherine A. Bareford

*Attorney, Agent, or Firm*—Kevin M. Kercher; Kathleen M. Ryan

[57] ABSTRACT

A method for applying a functionally gradient coating on a component, having a surface and subjected to one or more of rolling, sliding, abrasion and bending contacts, including the step of thermally spraying a functionally gradient material (FGM) on said surface that forms an FGM coating, said FGM coating having a thickness, a plurality of material compositions and a plurality of elastic modulus profiles. Each elastic modulus profile consists of a plurality of elastic modulii at a plurality of corresponding points within that thickness. The elastic modulii are in the range from about 28 Mpsi to about 60 Mpsi. Optionally, there is also a plurality of carbon content profiles.

17 Claims, 8 Drawing Sheets

PROCESS FOR APPLYING A FUNCTIONAL GRADIENT MATERIAL COATING TO A COMPONENT FOR IMPROVED PERFORMANCE

This application is a continuation-in-part of application Ser. No. 08/720,845, filed Oct. 3, 1996, now abandoned, which is a divisional of Ser. No. 08/658,332, filed Jun. 5, 1996 (now abandoned).

The Government has the rights in this invention pursuant to Contract No. 70NANB4H1414 awarded by NIST.

TECHNICAL FIELD

The present invention relates generally to the application of functionally gradient materials (FGMs) in the design of various components and more particularly, to use of FGM coatings on machine components subjected to one or more of rolling, sliding, abrasion, and bending contacts in order to increase their performance characteristics.

BACKGROUND ART

Gears, bearings, camshafts, planet shafts, and other engine, transmission, and/or undercarriage components in a machine, such as an earthworking machine, are constantly subjected to rolling and/or sliding contacts. Track links, track rollers, bushings, idlers and ground engaging tools (GETs) are generally also subjected to abrasive wear and/or bending forces. In order to increase the durability and reliability of the components that experience such contacts, these metallic components are usually case hardened. Case hardening results in the component having a harder outer surface and a relatively softer inner core and is accomplished by methods such as carburizing, induction hardening, flame hardening, or other selective hardening processes known to those skilled in the art of heat treatment.

One disadvantage of case hardening by these case hardening processes is that hardness gradients are introduced through a differential gradient of martensitic and non-martensitic structures that is independent of the elastic modulus of the component. Thus, even though the outer surface of the component may have a greater hardness than the inner core and consequently have better wear resistance, if the loads or stresses are kept constant, the deflection or strains of the component is unchanged. In other words, the component still undergoes a constant amount of deflection at a constant load. This inability to tailor a component's deflection at greater loads has long been a bottleneck in the design of various types of components that are subjected to a variety of contacts enumerated above. It has been desirable to have components subjected to rolling and/or sliding load conditions that are designed to exhibit varying amounts of Von Mises stresses in response to a constant amount of deflection. In other words, it has been desirable to have components which are tailored to exhibit varying amounts of deflection at a fixed amount of load, thus tailoring the bending or contact fatigue resistance or wear resistance of the component according to its intended application in a machine. It has thus been desirable to have components having an elastic modulus profile in relationship to the depth from the surface of the component, and also in relationship to the geometrical configuration of the component, so as to obtain components that exhibit a desired amount of fatigue or wear resistance enhancement when subjected to one or more of rolling, sliding, abrasion or bending contacts.

The present invention is directed to overcome one or more problems of heretofore utilized components that are subjected to one or more of rolling, sliding, abrasion, or bending contacts.

DISCLOSURE OF THE INVENTION

An aspect of the present invention, a process for applying a functionally gradient coating on a component, having a surface and is subjected to one or more of rolling, sliding, abrasion or bending contacts, including the step of thermally spraying a functionally gradient material (FGM) on said surface that forms an FGM coating, said FGM coating having a thickness, a plurality of material compositions and a plurality of elastic modulus profiles. Each elastic modulus profile consists of a plurality of elastic modulii at a plurality of corresponding points within that thickness. The elastic modulii are in the range from about 28 Mpsi to about 60 Mpsi. Optionally, there is also a plurality of carbon content profiles.

The component comprises a surface that FGM coating has a thickness. The FGM coating has a plurality of material compositions. The material selected for these applications are alloy steels. The FGM composition is adjusted in such a manner that hard particulates, such as metal carbides, borides, nitrides or oxides, with higher elastic modulii than steel are added to raise the resultant elastic modulus of the FGM coating. Carbon content can also be adjusted throughout the FGM layer in such a manner that a gradient of martensite start (Ms) temperatures is developed that will enable the resultant residual stress gradient in the article to be controlled.

BEST MODE FOR CARRYING OUT THE INVENTION

Figure 1:
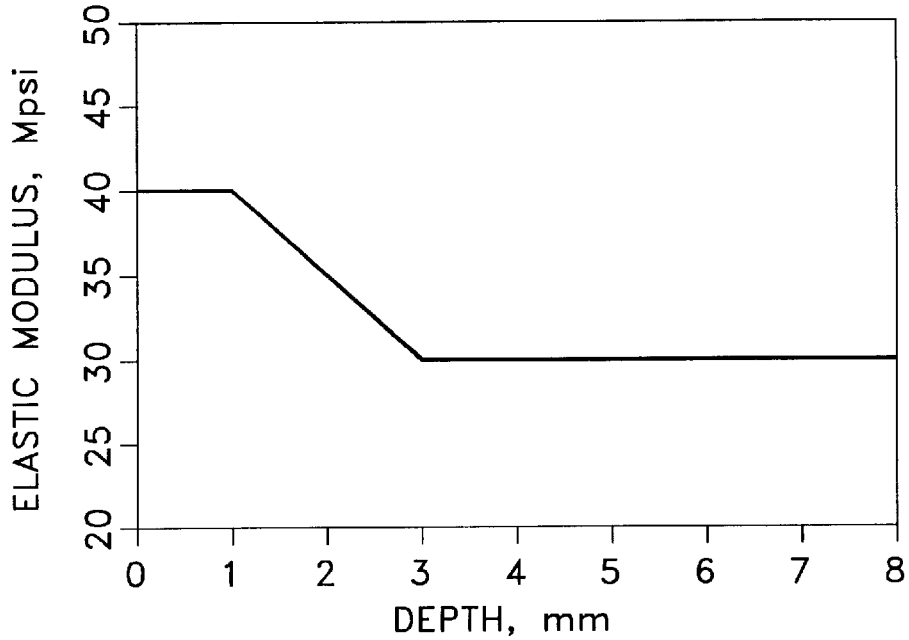
FIG. 1 is a graphical illustration of the tailored elastic modulus profile of a component having an FGM coating, according to one embodiment of the present invention.

As used in this description and in the claims, the term "rolling contacts" describes the area of contact between two bodies wherein the motion of one surface relative to the other surface can be described with a linear velocity as well as a rotational velocity.

The term "rolling contacts" includes contacts where the surface velocities at the point of contact are equal and parallel, such as for example, in anti-friction bearings.

The term "rolling/sliding contacts" describes a similar contact, however, there is significant difference in the surface velocities of the two contacting surfaces that causes a sliding component of the contact, for example, such as in gears.

As used in this description and in the claims, the term "sliding contacts" describes the area of contact between two bodies where one surface is stationary and the motion of one surface relative to the second surface is described with a velocity vector which coincides with the contact interface. Fuel injector plunger, barrel assemblies, and journal bearings are some examples of components subjected to sliding contacts.

As used in this description and in the claims, the term "abrasion contacts" describes a contact between two surfaces where material is removed from one surface by the combined force and velocity of the second surface. This material removal can be large, for example, in abrasive wear of GET's, or small and localized, for example, in the scoring of gear teeth.

As used in this description and in the claims, the term "bending contacts" describes the area of contact between two bodies where a load is applied in a cantilever manner to the component, which creates resultant stresses in the component away from the area of contact. For example, GET's such as bucket tips are subjected to bending contacts.

As used in this description and in the claims, the term "functionally graded materials" means a material which has a continuously varying composition and/or microstructure from one boundary to another.

As used in this description and in the claims, the term "elastic modulus" means the elastic modulus as determined by ASTM Method E111, "Standard Test Method for Young's Modulus, Tangent Modulus and Chord Modulus".

The term "thermal spray deposition", as used herein means the thermal spray techniques such as, oxyacetylene torch thermal spray, gas stabilized plasma spray, water stabilized plasma spray, combustion thermal spray, and high velocity oxygen fueled spray (HVOF). It must be understood that the thermal spray techniques are not limited to the above enumerated methods and that other alternative thermal spray techniques known to those skilled in the art may be employed. A technical publication titled "Thermal Spray Processing of FGMs", by S. Sampath, H. Herman, N. Shimoda, and T. Saito, published in the MRS Bulletin, pages 27–31, January 1995, and which is incorporated herein by reference, discloses a thermal spray method of depositing FGMs. A water stabilized plasma spray apparatus is described in U.S. Pat. No. 4,338,509,which is incorporated herein by reference.

Another technical article titled "Advanced Thermal Spray Coatings for Corrosion and Wear Resistance", by R. C. Rucker, Jr., and A. A. Ashary, published in Advances in Coatings Technologies for Corrosion and Wear Resistant Coatings, 1995, pages 89–98 describes various thermal spray processes, and is incorporated herein by reference.

The term "bonded" as used herein means a bond of a thermally sprayed coating to a substrate due to mechanical interlocking with asperities on the surface of the substrate. This mechanical interlocking is obtained by roughening the surface of the substrate, say, by grit blasting. The bond strengths of coatings are measured by ASTM Recommended Practice C633.

In the preferred embodiment of the present invention, a component having a surface is provided. Desirably, the surface is clean and free of contaminants. Cleaning can be accomplished a various means known to one skilled in the art, including cleaning by solvents, de-greasing, grit blasting, chemical etching and ultra-sonic cleaning.

In the preferred embodiment of the present invention, an FGM is desirably thermally sprayed on the substrate surface, and preferably, sprayed by gas or water stabilized plasma spray. An FGM coating is formed on the surface. The FGM coating desirably has a thickness in the range of about 0.5 mm to about 20 mm. A thickness less than 0.5 mm is undesirable because it is too thin to tailor a modulus profile by varying FGM composition. A thickness greater than 20 mm is undesirable because it represents a waste of labor and materials.

In the preferred embodiment of the present invention, the FGM coating also has a plurality of material compositions. The FGM coating further has a plurality of elastic modulus profiles. The FGM coating can further have a plurality of carbon gradient profiles. These carbon gradient profiles will create a gradient of martensite start (Ms) temperatures which can be used in alone or in conjunction with the elastic modulus profiles to create residual stress profiles that can improve the performance of the component. Desirably, the elastic modulus and carbon gradient profiles vary at various locations on the component surface depending on the amount and severity of the contact that the component is subjected to in the actual application. Preferably, the shape of the elastic modulus curve versus the thickness of the coating is also tailored to provide maximum load bearing capacity for a given deflection. The shape of the residual stress curve will be tailored to provide maximum compressive residual stresses at the surface and in the near surface material. The elastic modulus profile consists of a plurality of elastic modulii at a plurality of corresponding points within that thickness. The elastic modulii are preferably in the range of from about 28 Mpsi to about 60 Mpsi, as used herein, the unit "Mpsi" means million pounds per square inch.

There can be two alternative embodiments of the present invention. The first embodiment involves components where the surface material wears away and is consumed during the life of the component. Track rollers, track links, and ground engaging tools are examples of these types of components. The second embodiment involves components where the part geometry is intended to remain essentially intact for the entire life of the component. Gears, bearings and camshafts are examples of this version. It is recognized that there will be some small amount of wear experienced in these components during their life, but it is minimal and generally less than 0.25 mm. The embodiment utilized will depend on the type of application and the type of applied contact for that particular component.

Another aspect of the second embodiment is that the FGM carbon gradient profile in conjunction with the elastic modulus profile can provide beneficial residual stress profiles to improve component life. There is generally no need to control the carbon gradient profile in the first embodiment, since the surface material will be worn away during the life of that component.

The article with the appropriate functionally graded material (FGM) coating shall be heat treated. In the case of an FGM where there is no significant difference between the carbon content of the FGM layer or the base material, the component shall be austenitized by any means available to one skilled in the art of heat treating such as furnace heating or induction heating, and so forth. The temperature shall be selected such that after austenitization, the matrix shall consist of austenite or austenite with carbides, nitrides or oxides. This temperature is typically 27.7° C. (50° F.) to 55.6° C. (100° F.) above the $Ac_3$ temperature for hypoeutectoid steels and the $Ac_1$ temperature for hypereutectoid steels. The time shall be selected such that full austenitization is accomplished within all sections of the component. The component shall them be quenched in a medium which will effect a martensitic transformation in the FGM layer. The cooling rate reduces as one traverses from a component's surface to the component's core. The percentage of martensitic transformation will also diminish from the surface to core. Hardenability should be selected commensurate with component size to match hardness, strength, and microstructure of the finished article in accordance with engineering/design requirements.

In the case of an FGM where there is a carbon gradient in the near surface FGM, the component shall be austenitized by any means available to one skilled in the art of heat treating such as furnace heating or induction heating, and so forth. The temperature shall be selected to fully austenitize the core material, as well as the FGM layer. The temperature is typically 27.7° C. (50° F.) to 55.6° C. (100° F.)above the $Ac_3$ temperature for the core material. For a steel with 0.20 weight percent carbon, the typical temperature is approximately 871° C. (1600° F.) The time shall be selected such that full austenitization of both FGM case and core material is achieved within all sections of the component. The article shall them be quenched in a medium that will effect a martensitic transformation in the FGM layer and the core material as hardenability allows. The cooling rate reduces as one traverses from a component's surface to the component's core. The percentage of martensitic transformation will also diminish from the surface to core. Hardenability should be selected commensurate with component size to match hardness, strength and microstructure of the finished article in accordance with engineering/design requirements.

In the first embodiment of the present invention we have a component, such as a track roller, track link or ground engaging tool, with an FGM coating layer having a thickness of around 3 mm (0.118 inches) to 20 mm (0.78 inches). The elastic modulii being in the range of about 15% to about 30% greater in the initial 25% of the coating thickness as measured from the surface of the coating as compared to a final 25% of the coating thickness as measured from the surface of the coating as shown in Tables A2, B2, and C2 and the respective graphical representations in FIG. 1, 2, and 3. One skilled in the art can develop suitable elastic modulus profiles for a certain type of a contact situation without undue experimentation by simply conducting a finite element analysis (FEA) of the component in a dynamic load situation by computer simulation. An elastic modulus less than about 28 Mpsi is unachievable when utilizing ferrous-based materials. An elastic modulus greater than 60 Mpsi is undesirable because it is impractical to obtain and represents an unnecessary waste of labor and resources for the intended component applications.

Figure 4:
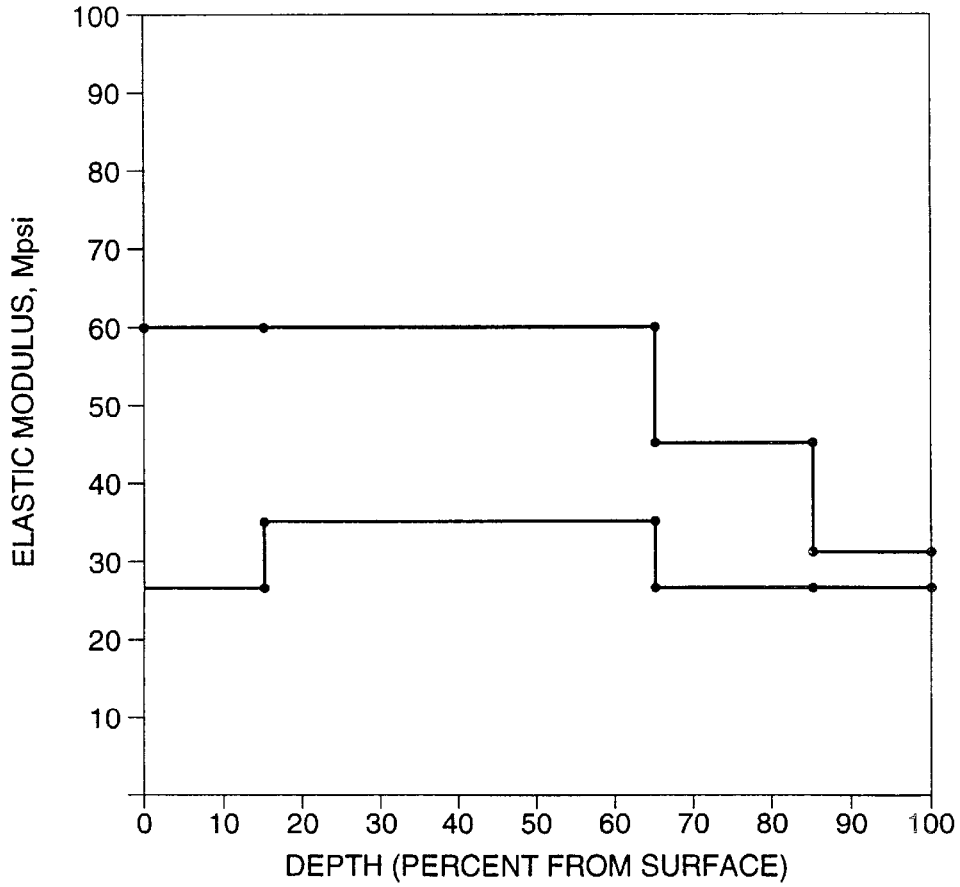
FIG. 4 is a graphical illustration of upper and lower limits of elastic modulus versus depth from the surface of a component of a first embodiment of the present invention, where a FGM coating is intended to wear away and be consumed.

Referring now to FIG. 4, in the preferred embodiment for the first embodiment of wear components that are subjected to abrasive contacts, a functionally graded material (FGM) is thermally sprayed on the surface of a component that forms an FGM coating, the FGM coating having a thickness, a plurality of material compositions, and a sequence of two to four elastic modulus profiles. For descriptive purposes there shall be four profile ranges, but sequential profiles may be identical, thus yielding the appearance of two profile ranges in the FGM layer, similar to that shown in FIG. 2. FIG. 4 reveals both an approximate upper range of modulus profiles and a lower range of modulus profiles versus depth from the surface of the component.

The component is subject to one or more of rolling, sliding, abrasion and bending contacts. The first elastic modulus profile is in a range from about 28 Mpsi to about 60 Mpsi from the surface of the coating to about 15% of the coating thickness as measured from the surface of the coating. The second elastic modulus profile is in a range from about 35 Mpsi to about 60 Mpsi from the surface of the coating from about 15% to about 65% of the coating thickness as measured from the surface of the coating. The third elastic modulus profile in a range from about 45 Mpsi to about 28 Mpsi from the surface of the coating from about 65% to about 85% of the coating thickness as measured from the surface of the coating and the fourth elastic modulus profile in a range from about 32 Mpsi to about 28 Mpsi from the surface of the coating to about 85% from about 100% of the coating thickness as measured from the surface of the coating. Another elastic modulus profile has it's first elastic modulus profile in a range from about 30 Mpsi to about 60 Mpsi from the surface of the coating to about 15% of the coating thickness as measured from the surface of the coating. The second elastic modulus profile is in a range from about 30 Mpsi to about 60 Mpsi from about 15% to about 65% of the coating thickness as measured from the surface of the coating. The third elastic modulus profile is in a range from about 30 Mpsi to about 45 Mpsi from the surface of the coating from about 65% to about 85% of the coating thickness as measured from the surface of the coating and the forth elastic modulus profile is in a range from about 30 Mpsi to about 32 Mpsi from the surface of the coating from about 85% to about 100% of the coating thickness as measured from the surface of the coating.

Figure 5:
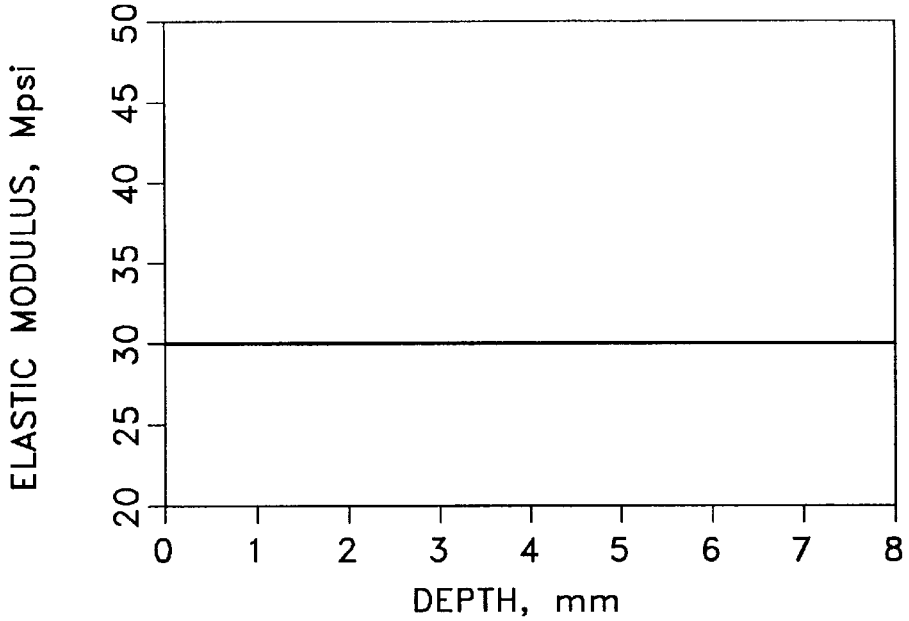
FIG. 5 is a graphical illustration of the elastic modulus profile of a case hardened component.

Prior to the Applicants' invention and as previously stated, these wear components were through hardened or case hardened by processes such as induction or flame hardening. These processes resulted in hardness gradients from the surface to core, but did not have modifications of elastic modulus profiles, as shown in FIG. 5.

Figure 6:
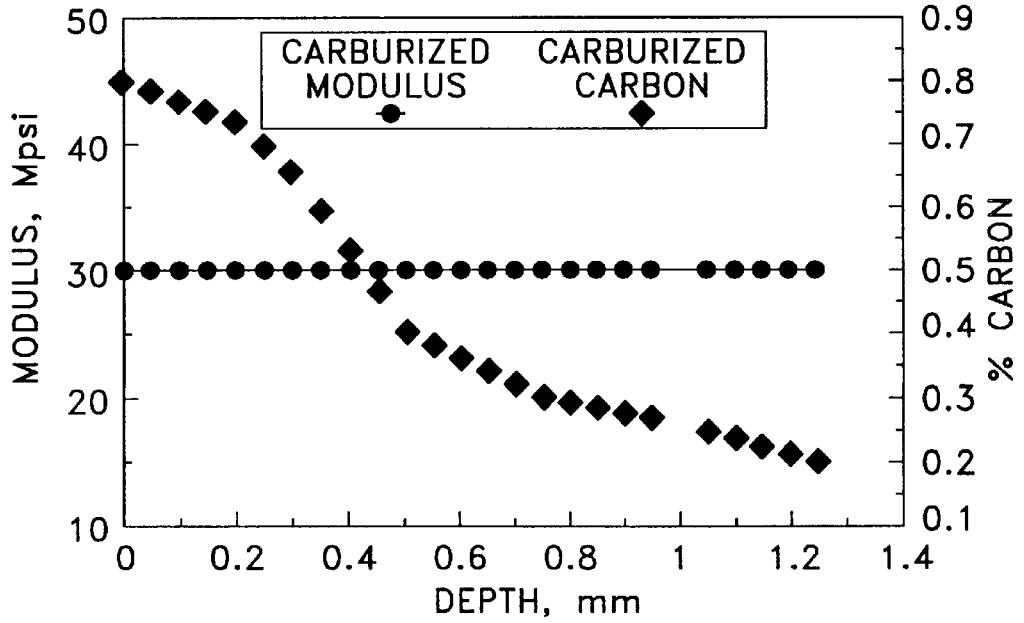
FIG. 6 is a graphical illustration of both the percentage of carbon and elastic modulus versus depth for a carburized, case hardened, non-FGM component.

In the second embodiment of the present invention, a typical component would be a gear, bearing, or camshaft, with an FGM coating layer having a thickness of around 0.5 mm (0.02 inches) to 4 mm (0.16 inches). The components relating to the second embodiment are designed for transmission of power, and are designed such that the entirety of the component is intended to remain intact for the life of the component. The case hardening process is typically performed using a diffusion controlled carburizing process. The resultant carbon gradient profile and elastic modulus profile are shown in FIG. 6. The resultant residual stress profile is shown on FIG. 7.

Figure 7:
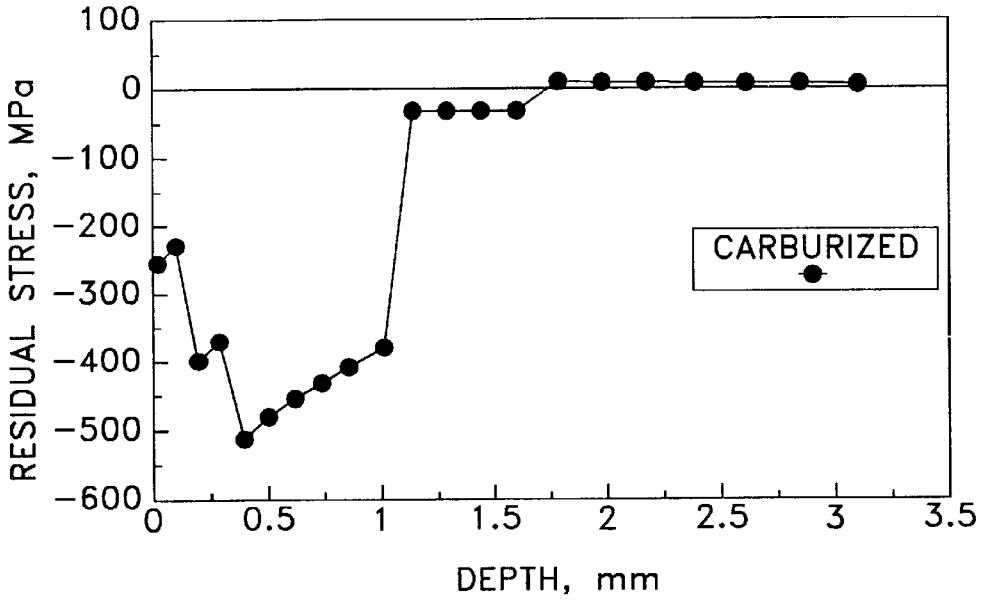
FIG. 7 is a graphical illustration of the carburized, case hardened, non-FGM component of FIG. 5 showing residual stress versus depth.

Referring now to FIG. 6, the percent of carbon decreases as the depth of the component increases while the elastic modulus remains constant. As shown in FIG. 7, there is a significant amount of residual stress at a relatively low depth.

Figure 8:
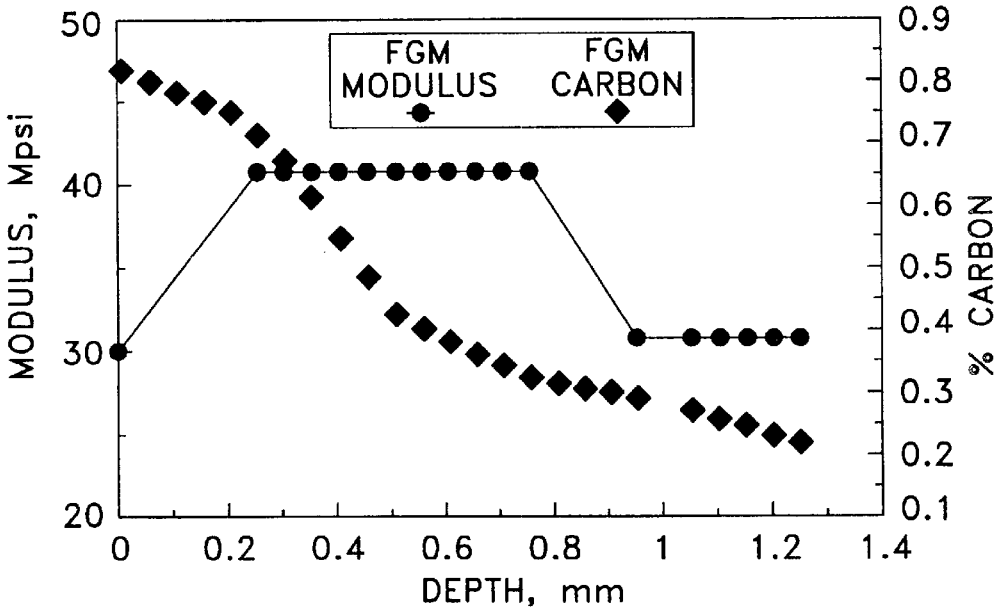
FIG. 8 is a graphical illustration of both the percentage of carbon and elastic modulus versus depth for a component for one example of a FGM coating where only the elastic modulus profile has been modified.
Figure 9:
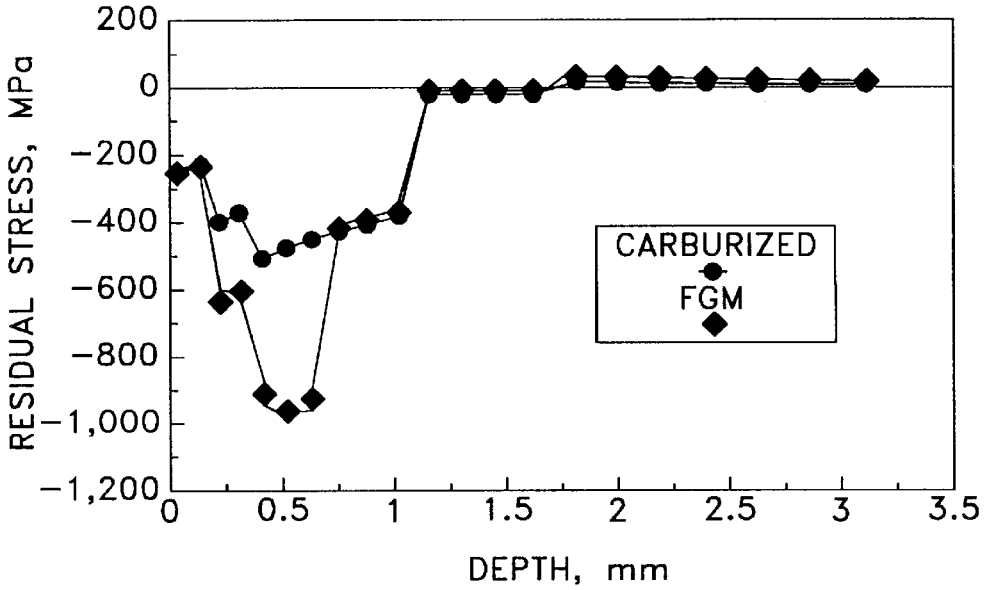
FIG. 9 is a graphical illustration of the component having a FGM coating of FIG. 7 showing residual stress versus depth compared to a carburized, case hardened, non-FGM component.

Referring now to FIG. 8, the elastic modulus and the percent of carbon content are illustrated for a component of the second embodiment having a FGM coating. The percent of carbon in the FGM coating is very similar to that found in the carburized component which could have a carbon profile gradient as illustrated in FIG. 6. In this example of FGM, the carbon gradient mimics that of a conventionally carburized component, but in addition, the elastic modulus profile is modified. The resultant residual stress gradient profile is depicted in FIG. 9. The elastic modulus can be described in a series of four profiles. The first elastic modulus profile is in a range from about 28 Mpsi to about 45 Mpsi from the surface of the coating to about 15% of the coating thickness as measured from the surface of the coating. The second elastic modulus profile is in a range from about 35 Mpsi to about 45 Mpsi from about 15% to about 65% of the coating thickness as measured from the surface of the coating. The third elastic modulus profile in a range from about 45 Mpsi to about 28 Mpsi from about 65% to about 85% of the coating thickness as measured from the surface of the coating and the fourth elastic modulus profile in a range from about 32 Mpsi to about 28 Mpsi to about 85% to about 100% of the coating thickness as measured from the surface of the coating.

The first elastic modulus profile is substantially lower at the surface of the coating than at 15% of the coating thickness as measured from the surface of the coating. In addition, the third elastic modulus profile is substantially higher at about 65% of the coating thickness as measured from the surface of the coating to about 85% of the coating thickness as measured from the surface of the coating.

As shown in FIG. 9, the subsurface residual stress of the thermally sprayed FGM coating is at least a factor of two times the amount of residual stress of a carburized component without a thermally sprayed FGM coating.

Figure 10:
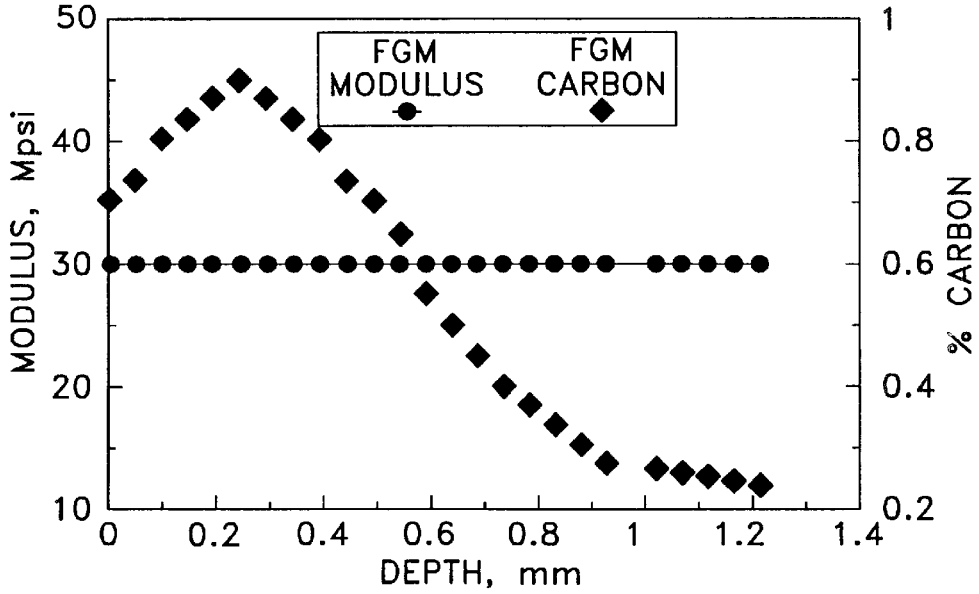
FIG. 10 is a graphical illustration of both the percentage of carbon and elastic modulus versus depth for a component for one example of a FGM coating where only the carbon gradient profile has been modified.
Figure 11:
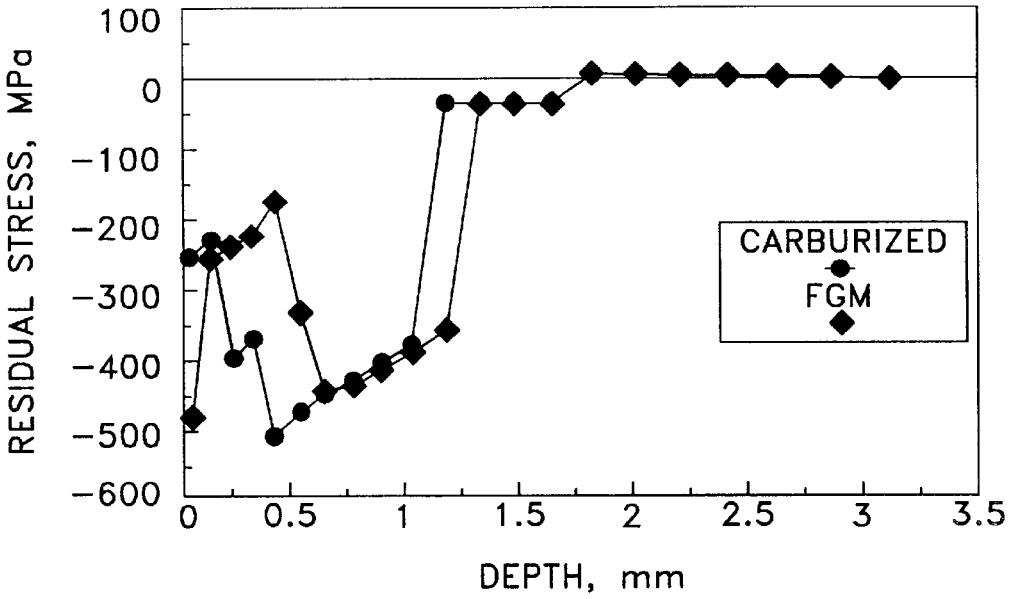
FIG. 11 is a graphical illustration of the component having a FGM coating of FIG. 9 showing residual stress versus depth compared to a carburized, case hardened, non-FGM component.

Referring now to FIG. 10, a FGM layer is applied to a component in such a manner that the carbon profile is modified in such a manner that the resultant residual stress is modified from that of a conventionally carburized component such as depicted in FIGS. 6 and 7. The carbon content can be describe in a series of four profiles. The first carbon content profile is in a range from about 0.75% to about 0.95% weight carbon from the surface of the coating to about 15% of the coating thickness as measured from the surface of the coating. The second carbon content profile is in a range from about 0.95% to about 0.35% weight carbon from the surface of the coating from about 15% to about 65% of the coating thickness as measured from the surface of the coating. The third carbon content profile is in a range from about 0.5% to about 0.1% weight carbon from the surface of the coating from about 65% to about 85% of the coating thickness as measured from the surface of the coating and the fourth elastic modulus profile in a range from 0.35% to about 0.1% weight carbon from the surface of the coating from about 85% to about 100% of the coating thickness as measured from the surface of the coating. The elastic modulus profile is not modified and remains constant throughout the coating. The resultant change to the residual stress is most significant at the surface, having increased by almost a factor of 2 over the standard carburized component, as shown in FIG. 11.

Figure 12:
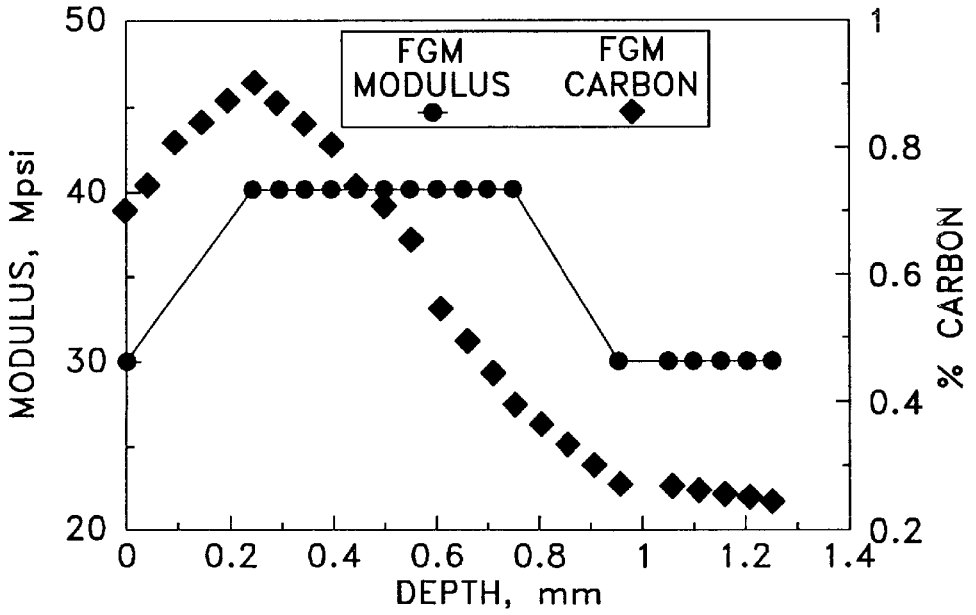
FIG. 12 is a graphical illustration of both the percentage of carbon and elastic modulus versus depth for a component for one example of a FGM coating where both the elastic modulus profile and carbon gradient profile have been modified.
Figure 13:
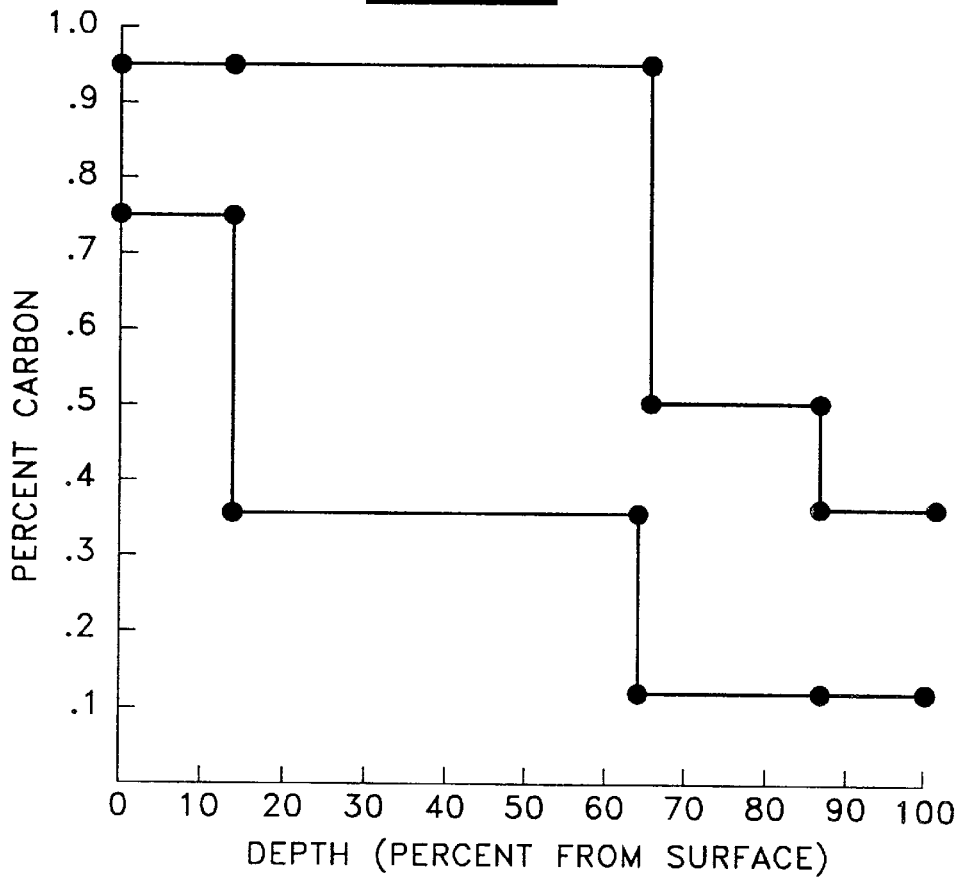
FIG. 13 is a graphical illustration of upper and lower limits of percent carbon versus depth from the surface of a component subject to abrasion and bending contacts and having a FGM coating.

Referring now to FIG. 12, an FGM coating is applied to a component such that both the carbon gradient profile and elastic modulus profile are modified from that of a conventional component. The carbon content can be describe in a series of four profiles. The first carbon content profile is in a range from about 0.75% to about 0.95% weight carbon from the surface of the coating to about 15% of the coating thickness as measured from the surface of the coating. The second carbon content profile is in a range from about 0.95% to about 0.35% weight carbon from the surface of the coating from about 15% to about 65% of the coating thickness as measured from the surface of the coating. The third carbon content profile is in a range from about 0.5% to about 0.1% weight carbon from the surface of the coating from about 65% to about 85% of the coating thickness as measured from the surface of the coating and the fourth elastic modulus profile in a range from 0.35% to about 0.1% weight carbon from the surface of the coating to about 85% to about 100% of the coating thickness as measured from the surface of the coating. Another illustration of carbon content, as a percentage, from the surface of the coating can be found in FIG. 13. Both the approximate upper carbon content range and lower carbon content range are depicted in relationship to depth from the surface of the component.

Figure 14:
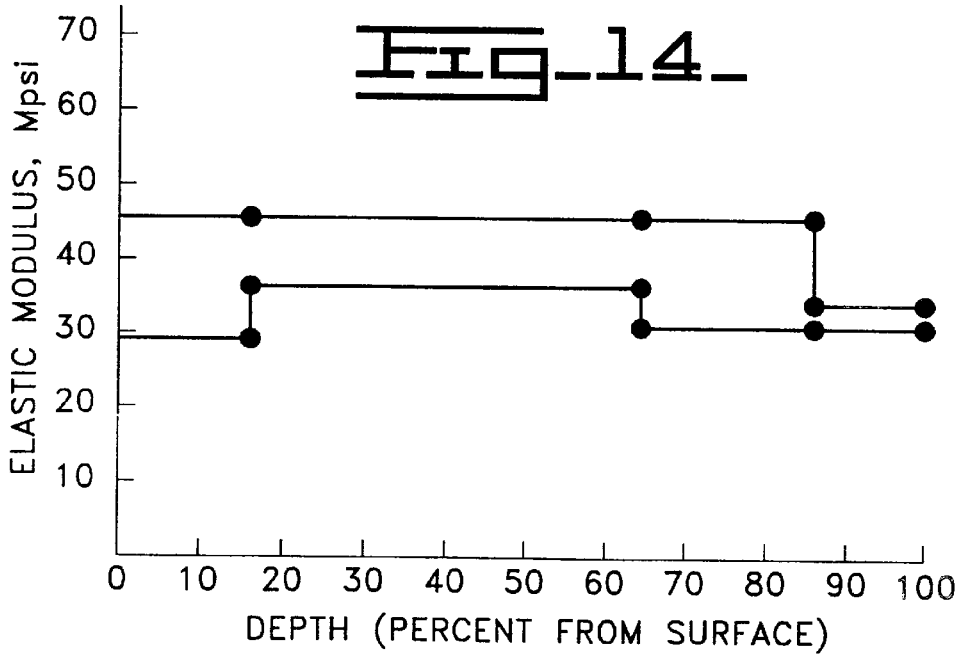
FIG. 14 is a graphical illustration of upper and lower limits of elastic modulus profiles versus depth from the surface of a component subject to one or more of rolling, sliding, abrasion and bending contacts and having a FGM coating.

In addition, the elastic modulus can be describe in a series of four profiles, in the same manner as illustrated in FIG. 8. The first elastic modulus profile is in a range from about 28 Mpsi to about 45 Mpsi from the surface of the coating to about 15% of the coating thickness as measured from the surface of the coating. The second elastic modulus profile is in a range from about 35 Mpsi to about 45 Mpsi from the surface of the coating from about 15% to about 65% of the coating thickness as measured from the surface of the coating. The third elastic modulus profile in a range from about 45 Mpsi to about 28 Mpsi from the surface of the coating from about 65% to about 85% of the coating thickness as measured from the surface of the coating and the fourth elastic modulus profile in a range from about 32 Mpsi to about 28 Mpsi from the surface of the coating from about 85% to about 100% of the coating thickness as measured from the surface of the coating. Another illustration of an approximate upper range of elastic modulus versus depth and an approximate lower range of elastic modulus versus depth, as a percentage, from the surface of the coating can be found in FIG. 14.

Figure 15:
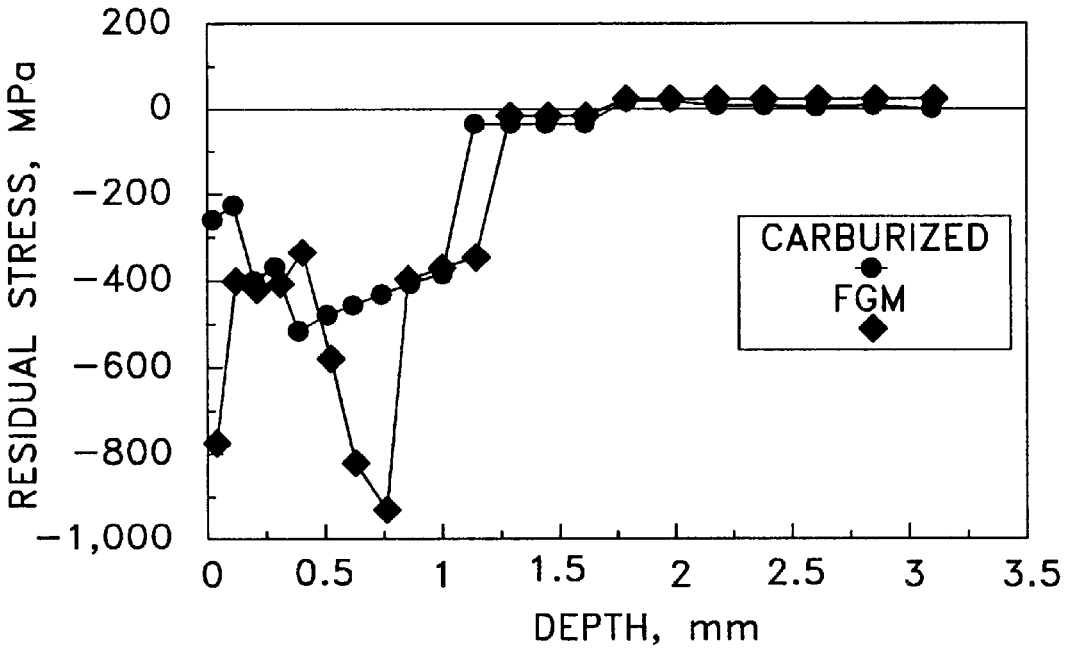
FIG. 15 is a graphical illustration of the component having a FGM coating of FIG. 11 showing residual stress versus depth compared to carburized, case hardened, non-FGM component.

As shown in FIG. 15, the surface having a thermally sprayed FGM coating with both the above described elastic modulus profiles and carbon content profiles has both a surface residual stress and subsurface residual stress that is at least a factor of two greater than a case hardened or carburized component. In addition, the depth of the subsurface residual stress is in a range of about 70% to about 90% greater than the subsurface residual stress of a case hardened or carburized component.

In both embodiments of the present invention, the preferred ceramic is desirably one of titanium carbide (TiC), tungsten carbide (WC), Cr2C3, MoFeB, BC4 and mixtures thereof. The term "cermet" as used herein, describes a type of material that includes a ceramic component and a metal component. Examples of cermets include Nickel-Chromium-Aluminum-Yttria alloy (NiCrAlY), Nickel-Chromium (NiCr) with Partially Stabilized Zirconia (PSZ), NiCrAlY with ZrO2 and Y203, nickel with Al203, tungsten carbide, and cobalt-chrome carbide. It must be understood that the present invention is not limited to any of the above enumerated materials and one skilled in the art may select other ceramic, cermet, or metallic materials.

The following Examples A, B, and C illustrate the process of the first embodiment of the present invention, as applied to the thermal spraying of an FGM coating on the substrate surface of a track roller for an earthworking machine, to obtain a tailored elastic modulus profile, which results in enhanced rolling, sliding and abrasion performance.

The following materials were used for thermally spraying an 8 mm thick FGM coating on a SAE Grade 41B35 substrate of a track roller by gas stabilized plasma spray: M4, TiC, WC, and A4635 steel alloy. The composition of the M4 material was as follows, by weight percent: C 1.5%, Si 0.39%, Mn 0.40%, P 0.015%, S 0.14%, Cr 4.57%, Ni 0.08%, Mo 4.58%, Cu 0.05%, Al 0%, Co 0.03%, V 3.9%, W 5.8%, N 0.04%, O 90 ppm and balance iron. The M4 material is supplied by Anval Corporation under the trade name "Anval M4". The composition of the A4635 material was as follows, by weight percent: C 0.35%, Si 0.005%, Mn 0.17%, P 0.006%, S 0.015%, Cr 0.03%, Ni 1.78%, Mo 0.54%, Cu 0.09%, Al 0%, Co 0%, V 0%, W 0%, N less than 0.001%, O 1100 ppm and balance iron. The A4635 material is manufactured by Hoeganaes Corporation by mixing a metal powder made by Hoeganaes having a trade name "Ancorsteel A4600V" with 0.5% by weight carbon. Similarly, A4690, A4670, and A4625 are manufactured by mixing "Ancorsteel A4600V" with 0.90, 0.70, 0.25 percent by weight carbon, respectively.

EXAMPLE A

An 8 mm thick FGM coating was deposited with the following compositional gradient profile on a SAE Grade 41B35 substrate, as shown in Table A1:

TABLE A1

| Starting Depth from Surface | Ending Depth from Surface | Layer Composition (volume %) |
|---|---|---|
| 0 mm | 1 mm | M4 with 30% TiC |
| 1 mm | 3 mm | M4 with 30% TiC graded to 100% M4 |
| 3 mm | 4 mm | 100% M4 |
| 4 mm | 8 mm | 100% M4 graded to 100% A4635 |

The FGM coating has the following elastic modulus profile, as shown in Table A2:

TABLE A2

| Starting Depth from Surface | Ending Depth from Surface | Elastic Modulus, Mpsi |
|---|---|---|
| 0 mm | 1 mm | 40 |

TABLE A2-continued

| Starting Depth from Surface | Ending Depth from Surface | Elastic Modulus, Mpsi |
|---|---|---|
| 1 mm | 3 mm | 40 graded to 30 |
| 3 mm | 4 mm | 30 |
| 4 mm | 8 mm | 30 |

The elastic modulus gradient of the above FGM is shown graphically in FIG. 1.

EXAMPLE B

An 8 mm thick FGM coating was deposited with the following compositional gradient profile on a SAE Grade 41B35 substrate, as shown in Table B1:

TABLE B1

| Starting Depth from Surface | Ending Depth from Surface | Layer Composition (volume %) |
|---|---|---|
| 0 mm | 4 mm | 50% A4635 and 50% TiC |
| 4 mm | 8 mm | 50% A4635 and 50% TiC graded to 100% A4635 |

The FGM coating has the following elastic modulus profile, as shown in Table B2:

TABLE B2

| Starting Depth from Surface | Ending Depth from Surface | Elastic Modulus, Mpsi |
|---|---|---|
| 0 mm | 4 mm | 47.5 |
| 4 mm | 8 mm | 47.5 graded to 30 |

Figure 2:
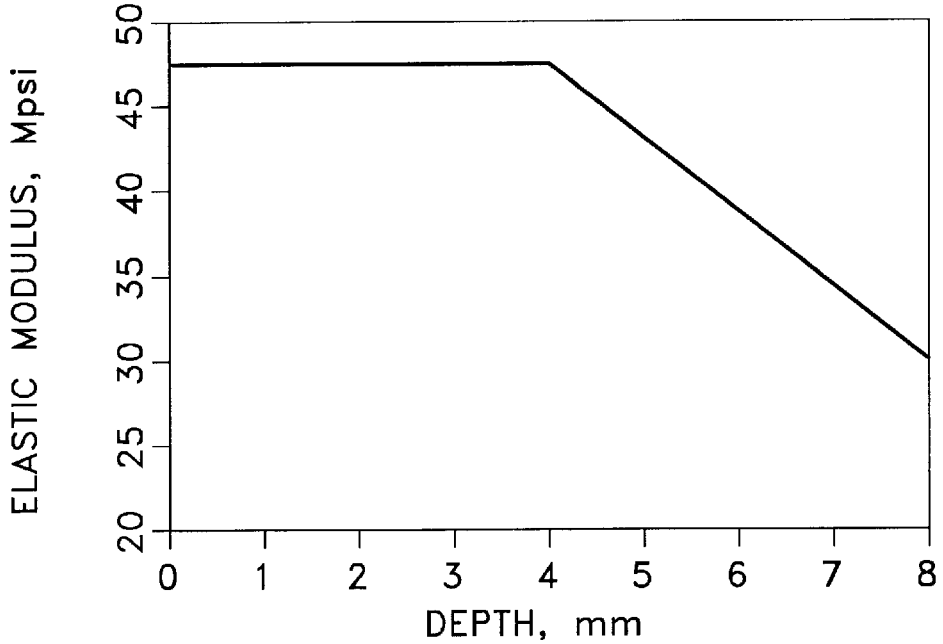
FIG. 2 is a graphical illustration of the tailored elastic modulus profile of a component having an FGM coating, according to another embodiment of the present invention.

The elastic modulus gradient of the above FGM is shown graphically in FIG. 2.

EXAMPLE C

An 8 mm thick FGM coating was deposited with the following compositional gradient profile on a SAE Grade 41B35 substrate, as shown in Table C1:

TABLE C1

| Starting Depth from Surface | Ending Depth from Surface | Layer Composition (volume %) |
|---|---|---|
| 0 mm | 1 mm | M4 with 30% WC |
| 1 mm | 3 mm | M4 with 30% WC graded to 100% M4 |
| 3 mm | 4 mm | 100% M4 |
| 4 mm | 8 mm | 100% M4 graded to 100% A4635 |

The FGM coating has the following elastic modulus profile, as shown in Table C2:

TABLE C2

| Starting Depth from Surface | Ending Depth from Surface | Elastic Modulus, Mpsi |
|---|---|---|
| 0 mm | 1 mm | 39 |
| 1 mm | 3 mm | 39 graded to 30 |
| 3 mm | 4 mm | 30 |
| 4 mm | 8 mm | 30 |

Figure 3:
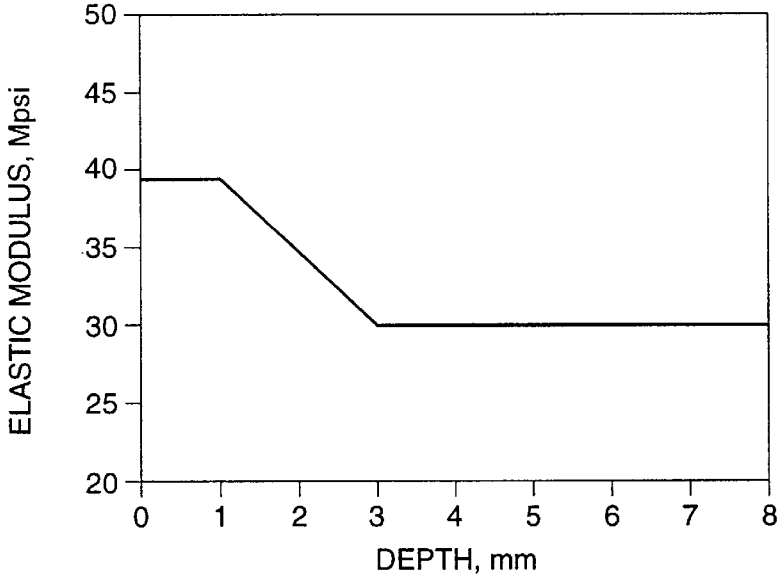
FIG. 3 is a graphical illustration of the tailored elastic modulus profile of a component having an FGM coating, according to yet another embodiment of the present invention.

The elastic modulus gradient of the above FGM is shown graphically in FIG. 3.

The following Example D illustrates the process of the second embodiment of the present invention, as applied to the thermal spraying of an FGM coating on the substrate surface of a gear for an earthworking machine, to obtain a series elastic modulus profiles, which results in enhanced sliding performance.

A 1.2 mm thick FGM coating was deposited with the following compositional gradient profile on a SAE Grade 4118 substrate, as shown in Table D1.

TABLE D1

| Starting Depth from Surface | Ending Depth from Surface | Layer Composition (volume %) |
|---|---|---|
| 0 mm | 0.2 mm | A4670 graded to A4690 with 30% TiC |
| 0.2 mm | 0.5 mm | A4690 with 30% TiC graded to A4670 with 30% TiC |
| 0.5 mm | 0.8 mm | A4670 with 30% TiC graded to A4625 with 30% TiC |
| 0.8 mm | 1.0 mm | A4625 with 30% TiC graded to A4625 |
| 1.0 mm | 1.2 mm | A4625 |

The FMG coating has the following elastic modulus profile, as shown in Table D2

TABLE D2

| Starting Depth from Surface | Ending Depth from Surface | Elastic Modulus, Mpsi |
|---|---|---|
| 0 mm | 0.2 mm | 30 graded to 40 |
| 0.2 mm | 0.8 mm | 40 |
| 0.8 mm | 1.0 mm | 39 graded to 30 |
| 1.0 mm | 1.2 mm | 30 |

The elastic modulus gradient and carbon composition gradients of the above FGM are shown graphically in FIG. 12.

INDUSTRIAL APPLICABILITY

The present invention is useful for making machine components that are constantly subjected to one or more of rolling, sliding, abrasion and bending contacts. Such components are typically various types of bearings, camshafts, planet shafts and gears used in engines and transmissions; track rollers, track links, track shoes and track links for the tracks of track-type tractors and earthmoving equipment and ground engaging tools.

Typically, the types of components that would be subjected to the first embodiment of the present invention would include track rollers, track links, track bushings and ground engaging tools. Also, of the above listed components, typically, the types of components that would be subjected to the second embodiment of the present invention would include gears, bearings, planet shafts and camshafts.

The present invention is particularly useful in enhancing the performance of components subjected to one or more of rolling, sliding, abrasion and bending contacts by using FGMs to provide FGM coated components which have a plurality of elastic modulus profiles as a function of coating thickness and component surface geometry.

The present invention is also useful for making gun barrels, steel mill rolls, and mill rolls for calendering and paper converting.

Other aspects, objects and advantages of this invention can be obtained from a study of the drawings, the disclosure and the appended claims.

We claim:

1. A method for applying a functionally gradient coating on a component, said component having a surface being subjected to one or more of rolling, sliding, abrasion and bending contacts, comprising the step of:

thermally spraying a functionally gradient material (FGM) on said surface forming an FGM coating, said FGM coating having a thickness, a plurality of material compositions, and a plurality of elastic modulus profiles, said elastic modulus profiles consisting of a plurality of elastic modulii at a plurality of corresponding points within said thickness and said elastic modulii being in the range of from about 28 Mpsi to about 60 Mpsi.

2. A method for applying a functionally gradient coating on a component, said component having a surface and subjected to one or more of rolling, sliding, abrasion and bending contacts, comprising the step of:

thermally spraying a functionally gradient material (FGM) on said surface that forms an FGM coating, said FGM coating having a thickness, a plurality of material compositions, and a plurality of elastic modulus profiles, said elastic modulus profiles consisting of:

a first elastic modulus profile in a range from about 28 Mpsi to about 45 Mpsi from said surface of the coating to about 15% of said coating thickness as measured from said surface of said coating;

a second elastic modulus profile in a range from about 35 Mpsi to about 45 Mpsi from about 15% to about 65% of said coating thickness as measured from said surface of said coating;

a third elastic modulus profile in a range from about 45 Mpsi to about 28 Mpsi from about 65% to about 85% of said coating thickness as measured from said surface of said coating; and a fourth elastic modulus profile in a range from about 32 Mpsi to about 28 Mpsi from about 85% to about 100% of said coating thickness as measured from said surface of said coating.

3. A method, as defined in claim 2, wherein said first elastic modulus profile is lower at said surface of the coating than at about 15% of said coating thickness as measured from said surface of said coating.

4. A method, as defined in claim 2, wherein said third elastic modulus profile is higher at about 65% of said coating thickness as measured from said surface of said coating to about 85% of said coating thickness as measured from said surface of said coating.

5. A method, as defined in claim 2, wherein said component is a bearing.

6. A method, as defined in claim 2, wherein said component is a camshaft for an internal combustion engine.

7. A method, as defined in claim 2, wherein said component is a gear.

8. A method for applying a functionally gradient coating on a component, said component having a surface and subjected to abrasion and bending contacts, comprising the step of:

thermally spraying a functionally gradient material (FGM) on said surface that forms an FGM coating, said FGM coating having a thickness, a plurality of material compositions, a plurality of elastic modulus profiles and a plurality of carbon content profiles, said elastic modulus profiles and carbon content profiles consisting of:

a first elastic modulus profile in a range from about 28 Mpsi to about 45 Mpsi and a first carbon content profile in a range from about 0.75% to about 0.95% weight carbon, from said surface of the coating to about 15% of said coating thickness as measured from said surface of said coating;

a second elastic modulus profile in a range from about 35 Mpsi to about 45 Mpsi and a second carbon content profile in a range from about 0.95% to about 0.35% weight carbon, from about 15% to about 65% of said coating thickness as measured from said surface of said coating;

a third elastic modulus profile in a range from about 45 Mpsi to about 28 Mpsi and a third carbon content profile in a range from about 0.5% to about 0.1% weight carbon, from about 65% to about 85% of said coating thickness as measured from said surface of said coating; and a fourth elastic modulus profile in a range from about 32 Mpsi to about 28 Mpsi and a fourth carbon content profile in a range from about 0.35% to about 0.1% weight carbon, from about 85% to about 100% of said coating thickness as measured from said surface of said coating.

9. The method, as defined in claim 8, wherein said first elastic modulus profile is lower at said surface of the coating than at about 15% of said coating thickness as measured from said surface of said coating.

10. The method, as defined in claim 8, wherein said third elastic modulus profile is higher at about 65% of said coating thickness as measured from said surface of said coating to about 85% of said coating thickness as measured from said surface of said coating.

11. A method for applying a functionally gradient coating on a component, said component having a surface and subjected to at least abrasion contacts, comprising the step of:

thermally spraying a functionally gradient material (FGM) on said surface that forms an FGM coating, said FGM coating having a thickness, a plurality of material compositions, and a plurality of elastic modulus profiles, said elastic modulus profiles consisting of:

a first elastic modulus profile in a range from about 30 Mpsi to about 60 Mpsi from said surface of the coating to about 15% of said coating thickness as measured from said surface of said coating;

a second elastic modulus profile in a range from about 30 Mpsi to about 60 Mpsi from about 15% to about 65% of said coating thickness as measured from said surface of said coating;

a third elastic modulus profile in a range from about 45 Mpsi to about 30 Mpsi from about 65% to about 85% of said coating thickness as measured from said surface of said coating; and a fourth elastic modulus profile in a range from about 32 Mpsi to about 30 Mpsi from about 85% to about 100% of said coating thickness as measured from said surface of said coating.

12. The method, as defined in claim 11, wherein said component is a track roller for the track of an earthworking machine.

13. The method, as defined in claim 11, wherein said component is a track link for the track of an earthworking machine.

14. The method, as defined in claim 11, wherein said component is a ground engaging tool for an earthworking machine.

15. The method, as defined in claim 11, wherein said component is a track shoe for the track of an earthworking machine.

16. The method, as defined in claim 11, wherein said component is a track bushing for the track of an earthworking machine.

17. The method, as defined in claim 11, wherein said component is a gear.

* * * * *